US007434984B2

(12) United States Patent
Hiranuma et al.

(10) Patent No.: US 7,434,984 B2
(45) Date of Patent: Oct. 14, 2008

(54) TIMEPIECE

(75) Inventors: Haruki Hiranuma, Chiba (JP); Kinshuroh Itoh, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 11/985,523

(22) Filed: Nov. 15, 2007

(65) Prior Publication Data

US 2008/0117723 A1 May 22, 2008

(30) Foreign Application Priority Data

Nov. 22, 2006 (JP) ..... 2006-315522

(51) Int. Cl.
*G04B 37/00* (2006.01)
*G04B 39/00* (2006.01)

(52) U.S. Cl. ..... 368/295

(58) Field of Classification Search ..... 368/294–295
See application file for complete search history.

(56) References Cited

U.S. PATENT DOCUMENTS

| | | | | |
|---|---|---|---|---|
| 5,822,279 | A * | 10/1998 | Cuche et al. | 368/295 |
| 6,616,329 | B1 * | 9/2003 | Sasaki et al. | 368/294 |
| 7,137,732 | B2 * | 11/2006 | Takeda | 368/295 |
| 2003/0099165 | A1 * | 5/2003 | Terasawa | 368/294 |
| 2003/0123332 | A1 * | 7/2003 | Hiranuma et al. | 368/295 |
| 2005/0141347 | A1 * | 6/2005 | Takeda | 368/295 |
| 2006/0114753 | A1 * | 6/2006 | Gerber | 368/295 |

FOREIGN PATENT DOCUMENTS

| | | |
|---|---|---|
| JP | 2003 270365 | 9/2003 |
| JP | 2005 326280 | 11/2005 |

* cited by examiner

*Primary Examiner*—Vit W Miska
(74) *Attorney, Agent, or Firm*—Adams & Wilks

(57) ABSTRACT

To provide a timepiece having a bezel which is easy to set in position, and which is not inadvertently rotatable after it has been set in position. A bezel is rotatably mounted on the bezel mounting portion of a case band. A click member is held vertically movably in the stepped hole of the case band and is urged toward the engaging portion of the bezel composed of a plurality of serrations. An operating member which has a depression having an oblique push-up surface and a closing surface contiguous to its push-up surface is held movably in a accommodating portion formed in the case band and crossing the lower end of the stepped hole at right angles thereto. The operating member is urged to its position in which its closing surface closes the lower end of the stepped hole. A stopper member capable of entering and leaving the depression along its push-up surface is positioned between the click member and the operating member. The member is movable to restrict the movement of the click member by the stopper member supported on its closing surface, while releasing the click member from such restriction and permitting its vertical movement by allowing the member to drop into the depression.

12 Claims, 6 Drawing Sheets

TIMEPIECE

BACKGROUND OF THE INVENTION

1. Field of the Invention

The present invention is concerned with a portable timepiece, such as a wrist or pocket watch, and more particularly relates to a timepiece having a rotatable bezel.

2. Description of the Related Art

It has hitherto been the case that a bezel mounted on a case band rotatably is held in a desired operating position by a structure producing a click feeling with its rotation. A click ball type and a leaf spring type are known as the structure for that purpose.

The click ball type has a click groove formed in the rear surface of a bezel and having engaging teeth formed by a plurality of serrations lying in the direction of rotation of the bezel, a steel ball engageable with the engaging teeth and a coil spring holding the steel ball against the engaging teeth. According to this structure, the rotation of the bezel in either of clockwise and counterclockwise directions as desired causes the steel ball to be pressed by the engaging teeth and deform the coil spring, whereby the rotation of the bezel is allowed. Each rotation of the bezel by a certain angle causes the steel ball to fall between every two adjoining engaging teeth of the click groove owing to the force of the coil spring and thereby produce a click feeling. Moreover, the steel ball falling between the engaging teeth of the click groove in the rotational position of the bezel in which its rotational force has been lost holds the bezel in its rotational position as desired (reference is made to, for example, Japanese Patent Publication JP-A-2003-270365 (Paragraphs 0002-0009 and FIG. 3)).

The leaf spring type has gear-like teeth formed on the case band of a watch case and a locking member and a pressing member which are attached to a bezel mounted rotatably on the case band. The locking member has a first locking portion which is engageable with the teeth on the case band for prohibiting the rotation of the bezel in one direction, and a second locking portion engageable with the teeth for prohibiting the rotation of the bezel in the direction opposite the one direction. The first and second locking portions are each formed by a leaf spring. The pressing member is a push button for pressing the first locking portion away from the teeth. Therefore, the bezel is rotatable in the one direction when the pressing member is pushed (while the second locking portion is elastically deformed to allow the passage of the teeth), and when the pressing member is released from pressure in any desired rotational position of the bezel, the first locking portion engages the teeth owing to its own elastic force. As a result, both of the first and second locking portions engage the teeth on the case band to ensure that the bezel be held in its desired rotational position (reference is made to, for example, Japanese Patent Publication JP-A-2005-326280 (Paragraphs 0015-0038 and FIGS. 1-10)).

Although the prior art on the click ball type makes the bezel rotatable in either of the clockwise and counterclockwise directions, it is only with low reliability that the bezel can be held in its desired rotational position, since only the force of a coil spring is relied on for holding the bezel in its desired rotational position. Therefore, it is possible that the bezel may be inadvertently rotated by an external force acting on the bezel when the time piece is carried.

As the prior art on the leaf spring type restricts the rotation of the bezel to one direction, it is impossible to reverse the rotation of the bezel in the event that an erroneous operation has caused the bezel to rotate somewhat away from its desired rotational position. Therefore, it is necessary and troublesome to give the bezel a substantially full rotation to bring it into its desired rotational position. Moreover, as the rotation of the bezel by pushing the pressing member attached thereto causes the movement of not only the bezel, but also the user's finger pushing the pressing member, an operational inconvenience arises from a tight and uncomfortable motion of the operating hand, particularly at the joint of the wrist, when a large amount of rotation has to be made, as when a substantially full rotation is given to the bezel with the timepiece worn on the wrist.

SUMMARY OF THE INVENTION

It is an aspect of the present invention to provide a timepiece having a bezel which is easy to set in position, and which is not inadvertently rotatable after it has been set in position.

The present invention comprises a case band having a bezel mounting portion formed by an annular recess which is open at its top and along its outer periphery, a stepped hole formed by a large diameter hole portion open in the bottom surface of the mounting portion and a small diameter hole portion connected with the lower end of that hole portion, and a accommodating portion connected with the lower end of the small diameter hole portion and crossing the stepped hole at right angles thereto; an annular bezel mounted in the bezel mounting portion rotatably both clockwise and counterclockwise relative to the case band and having an engaging portion formed in its rear surface facing the bottom surface of the bezel mounting portion by a plurality of serrations lying in the direction of its rotation; a click member held in the stepped hole vertically movably for engaging the engaging portion or disengaging therefrom; an urging body held in the large diameter hole portion for urging the click member toward the engaging portion normally; an operating member having a depression having an oblique push-up surface and a closing surface contiguous from the push-up surface at the open end of the depression and held in the accommodating portion movably to have its depression positioned in its unlocking position contiguous to the lower end of the small diameter hole portion by operation from outside the case band; an urging member urging the operating member normally for positioning the operating member in its locking position in which its closing surface closes the lower end of the small diameter hole portion; and a stopper member positioned between the click and operating members movably into and out of the depression along the push-up surface by movement of the operating member so that when it has left the depression and is supported on the closing surface, it may restrict the movement of the click member away from the engaging portion, while it relieves the click member from its restriction and allows its vertical movement when it has dropped into the depression.

According to the present invention, the click member is released from restriction when the operating member is moved to its unlocking position by resisting the urging member. When the operating member is situated in its unlocking position, its depression faces the lower end of the small diameter portion of the stepped hole and the stopper member drops into the depression owing to its own weight. On the other hand, as the click member is pushed up by the urging body, a clearance allowing the lowering of the click member is created between the click member and the stopper member spaced downwardly apart therefrom. That clearance is sufficiently large to enable the disengagement of the click member from the engaging portion of the bezel and thereby the rotation of the bezel.

When the bezel is rotated, the click member makes a click motion composed of its vertical movement caused by the convexities of the engaging portion of the bezel and the force of the urging body to the extent substantially corresponding to the height of the convexities of the engaging portion and its engagement and disengagement in and from the concavities of the engaging portion of the bezel and each such movement enables the click member to produce a click feeling. Moreover, the rotation of the bezel is not limited to one direction, but in the event that the rotation of the bezel has been excessive, it is possible to rotate the bezel in the opposite direction and bring it into its desired position easily without taking the trouble to give it a substantially full rotation. When the bezel is rotated as described, the user's finger holding in its unlocking position the operating member attached to the case band does not move with the rotation of the bezel. Therefore, even a substantially full rotation of the bezel hardly gives any tight and uncomfortable feeling to the wrist, etc., but the bezel can be rotated easily.

When the finger is moved away from the operating member after the bezel has been positioned, the operating member is moved into its locking position by the urging force of the urging member. As a result, the stopper member is pushed out of the depression by the oblique push-up surface thereof, while the closing surface of the operating member closes the lower end of the small diameter hole portion of the stepped hole and the stopper member which has been pushed out is supported on the closing surface. Consequently, the stopper member contacts or approaches the lower end of the click member engaging in a concavity of the engaging portion of the bezel whereby the click member is held in its position in which it cannot be disengaged from the engaging portion, or in its locked position. Its locked position is maintained unless it is artificially released therefrom, and the bezel which has been positioned can be held against any inadvertent rotation even if any external force tending to rotate the bezel may act on the time piece carried for use.

According to a preferred aspect of the present invention, the click member is formed by a shank having a lower end engageable with the stopper member from above and a semi-spherical head formed at the upper end of the shank as an integral part thereof engageably with the engaging portion, while supporting the urging body.

According to that aspect of the invention, the click member can be a single part.

According to a preferred aspect of the present invention, the click member is formed by a shank having a lower end engageable with the stopper member from above and a head rest at its upper end, and a head formed by a ball positioned on the head rest rotatably and engageably with the engaging portion.

According to that aspect of the invention, a smooth click motion can be realized, since the head formed by a ball rotates on the head rest each time the bezel is rotated. Moreover, the rotation of the head causes its area of contact with the engaging portion of the bezel to change, which is desirable for preventing the wear of the head in one specific area of contact from occurring to a greater extent than in any other area of the head.

According to a preferred aspect of the present invention, the accommodating portion is formed by a hole extending radially of the case band, the operating member is formed by an inserted shaft fitted slidably in the accommodating portion and a push button formed as an integral part of the shaft and protruding outward from the case band and the depression is defined by a single continuous groove formed along the circumference of the inserted shaft, while the closing surface is defined by the circumferential surface of the inserted shaft which is situated more inwardly of the case band than the depression is.

According to that aspect of the invention, the operating member provides easy operation, since the pressing of its push button is sufficient for bringing the operating member into its locking position. Moreover, the operating member is preferable for its simple construction, since the circumferential surface of its inserted shaft is utilized as its closing surface. Moreover, its depression is preferably defined by a single continuous groove formed along the circumference of its inserted shaft, so that the cutting of its inserted shaft with a lathe may form a groove having an oblique push-up surface conforming to the shape of its cutting edge.

According to a preferred aspect of the present invention, the stopper member is formed by a sphere.

That aspect of the invention is preferable for easy availability of a known steel ball or the like as the stopper member and the smoothness with which the stopper member can enter and leave the depression along its push-up surface.

The present invention provides a timepiece having a bezel which is easy to position as the operating member is moved to its unlocking position to release the click member from its locked position, and which can be held against any inadvertent rotation after it has been positioned, as the click member is locked when the hand is moved away from the operating member.

DESCRIPTION OF THE PREFERRED EMBODIMENTS

Figure 1:
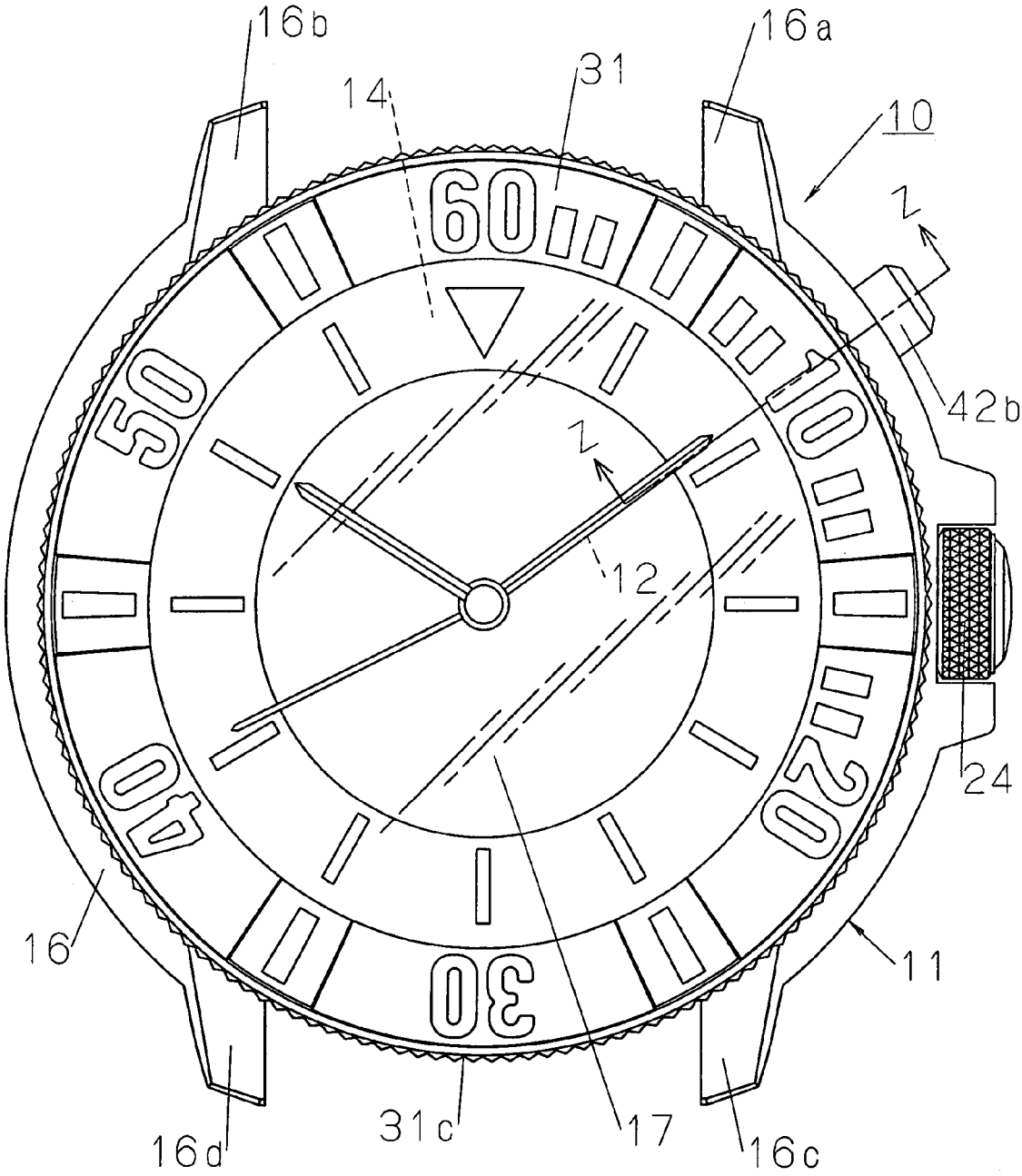
FIG. 1 is a front elevational view showing a watch according a first embodiment of the present invention.

A first embodiment of the present invention will now be described with reference to FIGS. 1 to 4.

In FIGS. 1 to 4, symbol 10 denotes a portable timepiece or watch worn, for example, on the wrist for use. The watch exterior assembly 11 which the watch 10 includes holds e.g. a watch movement 13 (shown in FIGS. 3 and 4) for driving pointers 12, a dial plate 14 attached to the watch movement 13 and a frame member 15 (shown in FIGS. 3 and 4) for holding the watch movement 13 in the watch exterior assembly 11.

Figure 3A:
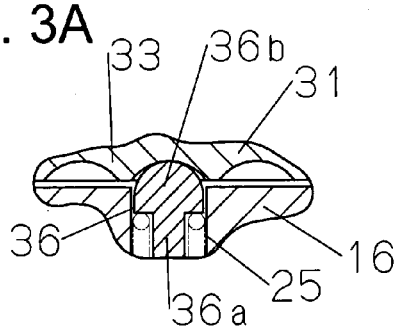
FIG. 3A is a sectional view taken along the line Z-Z in FIG. 1 and showing the position in which the bezel which the watch of FIG. 1 includes has been locked against rotation.
Figure 3B:
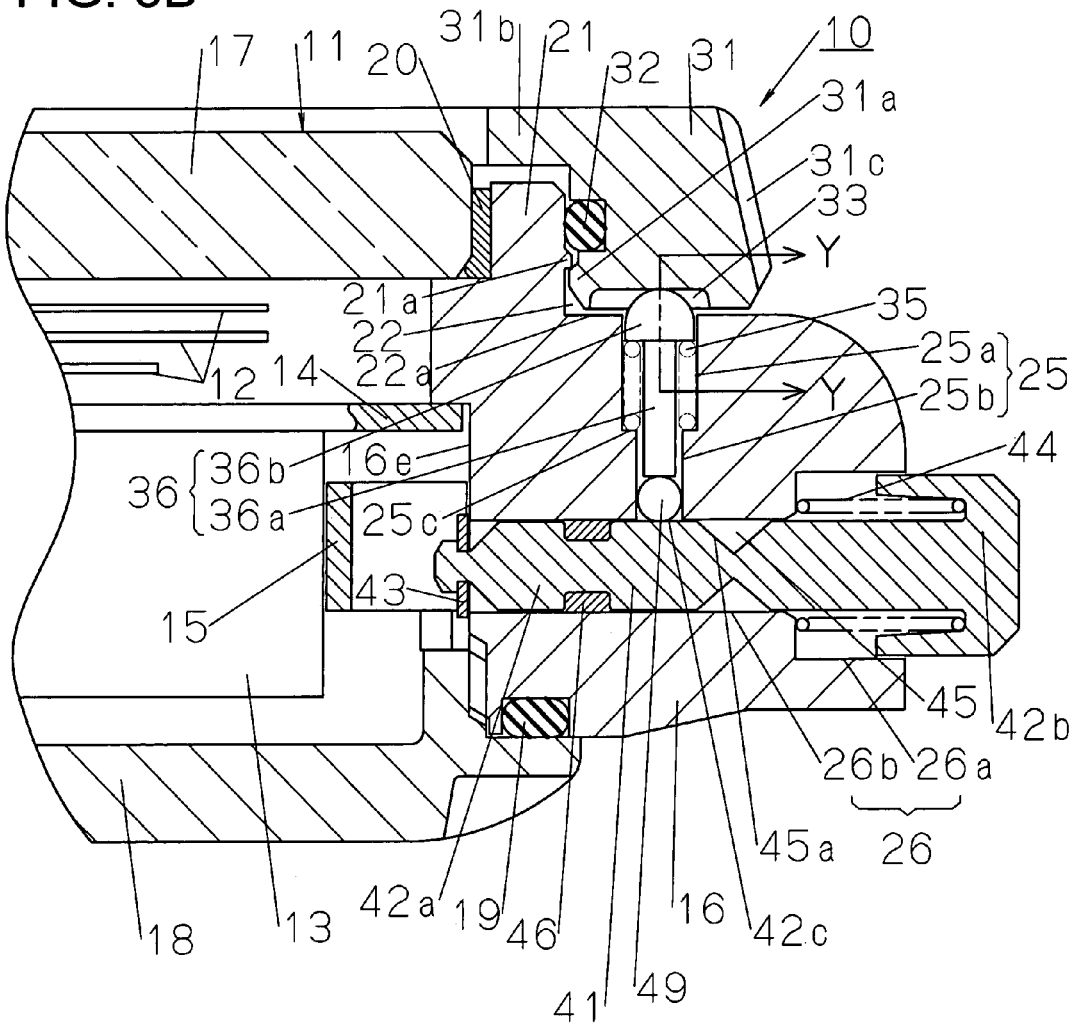
FIG. 3B is a sectional view taken along the line Y-Y in FIG. 3A.
Figure 4:
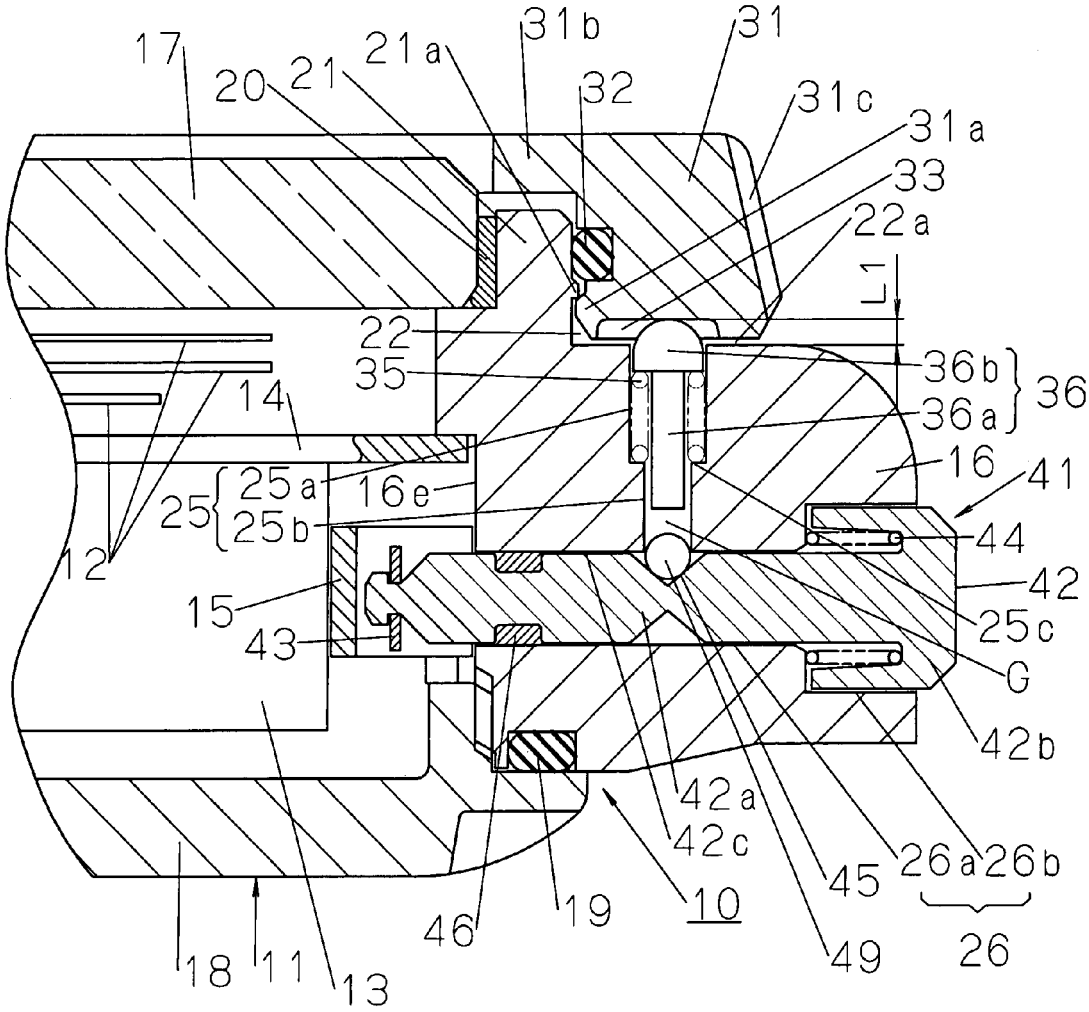
FIG. 4 is a sectional view taken along the line Z-Z in FIG. 1 and showing the position in which the bezel which the watch of FIG. 1 includes has been unlocked for rotation.

The watch exterior assembly 11 has a case band 16 preferably formed from a metal in an annular shape, a cover glass 17 attached in a liquid-tight way to one face of the case band 16 as viewed across its thickness (its front face) and aback cover 18 screwed removably to the other surface of the case band 16 as viewed across its thickness (its back face), as shown in FIGS. 1 to 4. The pointers 12 and the dial plate 14 are visible through the cover glass 17. In FIGS. 3 and 4, symbol 19 denotes an elastic annular waterproof gasket, such as an O-ring.

The case band 16 is provided at the end of its front face (upper face) with an annular convexity 21 protruding from its front face as an integral part thereof and an annular bezel mounting portion 22, as shown in FIGS. 3 and 4. The cover glass 17 is fitted along the inner periphery of the annular convexity 21 with an annular resin gasket 20 held therebetween. The annular convexity 21 has a circumferentially continuous annular engaging convexity 21*a* formed on its outer periphery and protruding into the bezel mounting portion 22. The bezel mounting portion 22 is open at its top and toward the outer periphery of the case band 16 and surrounds the annular convexity 21. The bezel mounting portion 22 has a bottom surface 22*a* situated below the engaging convexity 21*a* and connected to the bottom of the annular convexity 21 at right angles thereto.

Figure 2:
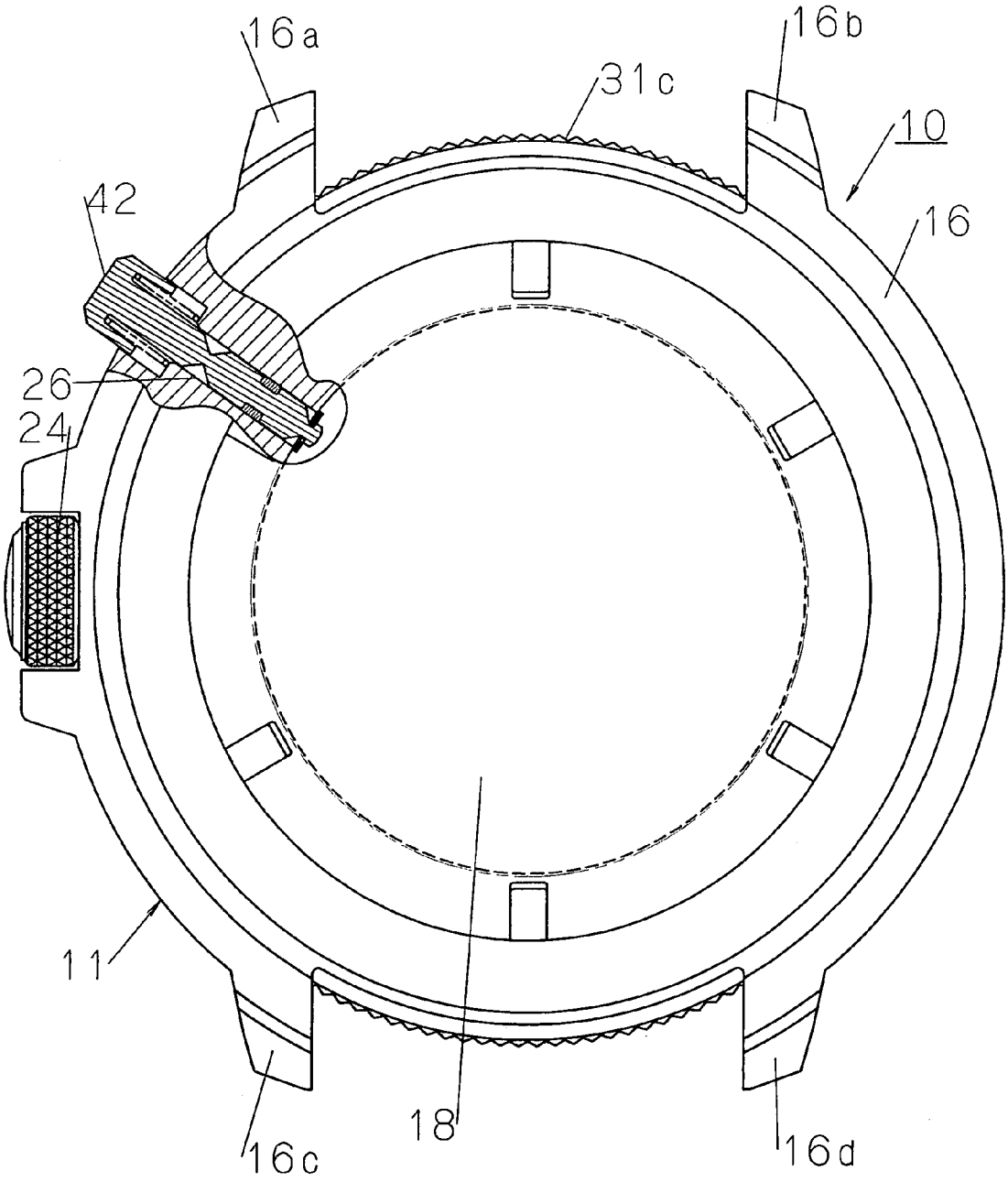
FIG. 2 is a rear elevational view, partly in section, of the watch of FIG. 1.

In FIGS. 1 and 2, symbol 24 denotes a winder for operating a stem not shown. A stepped hole 25 and a accommodating portion 26 are formed in the case band 16, as shown in FIGS. 3 and 4. While there are four lugs 16*a* to 16*d* (see FIGS. 1 and 2) to which a band or belt or like member not shown, but used to have the watch worn on the wrist is connected, the stepped hole 25 and the accommodating portion 26 are formed between two lugs 16*a* and 16*c* which are closer to the winder 24, and preferably between the winder 24 and the lug 16*a* situated toward the point indicating twelve o'clock. The stepped hole 25 and the accommodating portion 26 can alternatively be formed between the winder 24 and the lug 16*c* situated toward the point indicating six 6 clock.

As shown in FIGS. 3 and 4, the stepped hole 25 extends across the thickness of the case band 16, or in other words, vertically, and is formed by, for example, a large diameter hole portion 25*a* and a small diameter hole portion 25*b* both having a circular shape. The large diameter hole portion 25*a* has an upper end which is open in the bottom surface 22*a* of the bezel mounting portion 22. The small diameter hole portion 25*b* has a lower end which is contiguous to the lower end of the large diameter hole portion 25*a*, and a shoulder 25*c* is formed between the large and small diameter hole portions 25*a* and 25*b*.

The accommodating portion 26 is formed by, for example, a stepped hole extending radially of the case band 16, as shown in FIGS. 2 to 4. The accommodating portion 26 has a large diameter hole portion 26*a* having a circular cross section and open in the outer peripheral surface of the case band 16 and a small diameter hole portion 26*b* having a circular cross section and open in the inner peripheral surface 16*e* of the case band 16. The accommodating portion 26 crosses the stepped hole 25 at right angles thereto and the lower end of the small diameter hole portion 25*b* is connected with the middle portion of the small diameter hole portion 26*b*. Thus, the stepped hole 25 and the accommodating portion 26 cross each other in a T-shaped form and are connected with each other.

The watch exterior assembly 11 includes a bezel 31 situated to surround the dial plate 14. The bezel 31 is a rotational ring formed in an annular shape from a metal or synthetic resin, etc., is fitted in the bezel mounting portion 22 and is rotatable about the case band 16 in two directions, clockwise and counterclockwise. The bezel 31 has an annular inner peripheral convexity 31*a* engaging the engaging convexity 21*a* from below and is thereby held against detachment.

The bezel 31 has a cover portion 31*b* facing the upper end surface of the annular convexity 21. Moreover, the bezel 31 has a plurality or multiplicity of serrations 31*c* formed on its outer peripheral surf ace to prevent a finger from slipping when rotating it. In FIGS. 3 and 4, symbol 32 is a bezel gasket used in a compressed state, such as an elastic O-ring, and the bezel gasket 32 prevents the bezel 31 from becoming unstable.

An engaging portion 33 is formed in the rear surface of the bezel 31 facing the bottom surface 22*a* of the bezel mounting portion 22. The engaging portion 33 is formed by, for example, a plurality of serrations lying continuously in the direction of rotation of the bezel 31. The serrations forming the engaging portion 33 extend radially toward the center of the bezel 31. The number of the serrations may be 60 or 120. When the engaging portion 33 has its cross section taken along the circumference of the bezel 31 as shown in FIG. 3B, the downwardly directed convexities of the engaging portion 33 has a substantially triangular cross section and the concavities of the engaging portion 33 which are open in the rear surface of the bezel 31 have a substantially semi-spherical cross section.

A coil spring 35 is, for example, held in the large diameter hole portion 25*a* of the stepped hole 25 as an urging body having a central hollow extending vertically therethrough. The coil spring 35 has a lower end supported on the shoulder 25*c*. A click member 36 made of, for example, a metal is supported on the upper end of the coil spring 35.

The click member 36 is composed of a vertically extending shank 36*a* and a head 36*b* formed at its upper end as an integral part thereof. The click member 36 has a length which is smaller than that of the stepped hole 25. The head 36*b* is larger in diameter than the shank 36*a* having a circular cross section, is formed in a semi-spherical shape so sized as to fit in each concavity of the engaging portion 33 and has a rear surface (or lower surface) supporting the upper end of the coil spring 35 thereon.

The click member 36 is held in the stepped hole 25 vertically movably with its head 36*b* guided along the large diameter hole portion 25*a*. The head 36*b* has its upper portion protrude from the upper end of the large diameter hole portion 25*a* while the coil spring 35 is in its free state. When the bezel 31 is attached to the case band 16, the coil spring 35 is held in its compressed state by the click member 36. Accordingly, the click member 36 is normally urged upward, and held against the engaging portion 33 by the coil spring 35.

The case band 16 is provided with a locking mechanism 41 which holds the click member 36 against movement except when the bezel 31 is rotated, while it permits the movement of the click member 36 when the bezel 31 is rotated. The locking mechanism 41 has an operating member 42, an urging member, for example, a coil spring 44 and a stopper member 49.

The operating member 42 is inserted from outside the case band 16 movably in the accommodating portion 26. The operating member 42 is formed by an inserted shaft 42*a* and a push button 42*b* formed at one end thereof as an integral part thereof. The inserted shaft 42*a* having a circular cross section in a direction normal to its axis is fitted slidably in the small diameter hole portion 26*b* of the accommodating portion 26. The push button 42*b* is larger in diameter than the inserted shaft 42*a* and is fitted slidably in the large diameter hole portion 26*a* of the accommodating portion 26.

A stopper member, for example, a retaining ring 43 is attached to another end of the operating member 42 protruding into the inside of the case band 16. The retaining ring 43 is larger than the opening of the small diameter hole portion 26*b* open in the inner peripheral surface 16*e* of the case band 16 and is engageable with the inner peripheral surface 16*e* or disengageable therefrom with the axial movement of the operating member 42. An urging member, for example, a coil spring 44 is in its compressed state between the push button 42*b* and the bottom of the large diameter hole portion 26*a*. The inserted shaft 42*a* extends through the coil spring 44.

Accordingly, the operating member 42 is normally urged outwardly of the case band 16 by the coil spring 44. Thus, the retaining ring 43 is normally in contact with the inner peripheral surface 16*e* of the case band 16 to hold the operating member 42 in position, while the push button 42*b* is held in a state fully projecting from the outer peripheral surface of the case band 16, as shown in FIG. 3. Therefore, the pushbutton 42*b* can be pressed in to compress the coil spring 44 to a further extent and thereby move the operating member 42 toward the inside of the case band 16. The urging member, such as coil spring 44, can alternatively be situated between the stopper, such as retaining ring 43, and the frame member 15 inside the case band 16. The spring force (urging force) of the coil spring 44 is equal to, or greater than the spring force (urging force) of the coil spring 35 urging the click member 36.

The operating member 42 has a depression 45 in the middle portion of its inserted shaft 42*a*. The depression 45 has an opening which is larger in area than that of the small diameter hole portion 25*b* of the stepped hole 25. The depression 45 is situated immediately below the small diameter hole portion 25*b* and connected with the lower end opening of the small diameter hole portion 25*b* when the operating member 42 is pressed in and moved to its unlocking position as shown in FIG. 3A.

The depression 45 is formed by a single continuous groove extending along the circumference of the inserted shaft 42*a*, preferably a groove having a V-shaped cross-section. A push-up surface 45*a* is defined by an oblique surface of the depression 45 which is situated toward the inside of the case band 16. The depression 45 has such a depth that a part of the stopper member 49 and preferably substantially its upper half may protrude from the opening of the depression 45 when it has dropped therein.

The depression 45 is not limited to a groove having a V-shaped cross section, but may be a groove having any other shape if it has the push-up surface 45*a*. The depression 45 defined by a single continuous groove extending along the circumference of the inserted shaft 42*a* and having a V-shaped cross, section is preferable, since the cutting of the inserted shaft 42*a* with a lathe can form a depression 45 defined by a groove having an oblique push-up surface 45*a* conforming to the shape of its cutting edge, and since the direction of the depression 45 does not have to be taken into consideration when the operating member 42 is inserted into the case band 16 to make the assembly.

The circumferential surface of the inserted shaft 42*a* which is situated more inwardly of the case band 16 than the depression 45 is utilized as a closing surface 42*c* contiguous to the push-up surface 45*a*. The closing surface 42*c* is situated immediately below the small diameter hole portion 25*b* to close the lower end opening of the small diameter hole portion 25*b* when the operating member 42 is urged back by the coil spring 44 and moved to its locking position as shown in FIG. 3. The closing surface 42*c* defined by the circumferential surface of the inserted shaft 42*a* is preferable for the simple construction of the operating member 42, and since no special work is required on the operating member 42 to form the closing surface 42*c*.

The operating member 42 provides easy operation, since it is axially movable between its locking position as described and its unlocking position as shown in FIG. 4 to have its closing surface 42*c* or depression 45 face the lower end opening of the small diameter hole portion 25*b* selectively, and since the pressing of its push button 42*b* is sufficient for bringing the operating member 42 into its locking position. In FIGS. 3 and 4, symbol 46 denotes an annular waterproof gasket fitted about the inserted shaft 42*a* to ensure waterproofness between the engaging portion 33 and the operating member 42.

The stopper member 49 is a member separate from the click and operating members 36 and 42 and is situated between the click member 36 and the inserted shaft 42*a* of the operating member 42 located therebelow. A ball having a diameter smaller than the diameter of the small diameter hole portion 25*b* and capable of entering and leaving the depression 45, for example, a steel ball is used for the stopper member 49. The diameter D of the stopper member 49 composed of a sphere, the amount L of vertical movement of the stopper member 49 resulting from its entering or leaving the depression 45 and the height between the bottom surface 22*a* and the bottom of each concavity of the engaging portion 33, or in other words, the maximum amount L1 (see-FIG. 4) of movement expected from the click member 36 satisfy the relationship $D/2 \geqq L > L1$.

The use of a steel ball as the stopper member 49 is preferable for its easy availability. Moreover, as the free rotatability of the stopper member 49 enables it to enter and leave the depression 45 smoothly along the push-up surface 45*a*. Therefore, it is preferable, since no excessive pushing force is required for pressing in the operating member 42. It is possible to use as the stopper member 49 not only a sphere, but also a short rod having an upper and a lower portion and having a semi-spherical shape at least in its lower portion.

Description will now be made of a process for fitting the click member 36 and the locking mechanism 41, etc. to the case band 16.

Firstly, after the coil spring 44 is fitted about the inserted shaft 42*a* of the operating member 42 having the waterproof gasket 46 fitted thereon, the operating member 42 has its inserted shaft 42*a* inserted from outside the case band 16 into the accommodating portion 26 and the retaining ring 43 is attached to the end of the inserted shaft 42*a* inside the case band 16. Accordingly, the operating member 42 attached to the case band 16 is normally urged outwardly of the case band 16 by the spring force of the coil spring 44 held in its compressed state. Thus, the operating member 42 is situated in its locking position as shown in FIG. 3 and the closing surface 42*c* of its inserted shaft 42*a* closes the lower end of the small diameter hole portion 25*b* of the stepped hole 25, while the depression 45 is situated closer to the outside of the case band than the small diameter hole portion 25*b* is.

Then, the stopper member 49 is dropped into the stepped hole 25 from above and held in its small diameter hole portion 25*b*, and the coil spring 35 is put into the large diameter hole portion 26*a* of the stepped hole 25 from above. Moreover, the click member 36 has its shank 36*a* inserted into the stepped hole 25 from above. As a result, the shank 36*a* extends through the coil spring 35 and the click member 36 has its head 36*b* fitted in the large diameter hole portion 26*a* and supported on the upper end of the coil spring 35.

Thereafter, the bezel 31 having the bezel gasket 32 attached thereto is fitted in the bezel mounting portion 22 of the case band 16 and its inner peripheral convexity 31*a* is engaged with the engaging convexity 21*a* of the case band 16. As a result, the bezel 31 is situated rotatably relative to the case band 16. When the bezel 31 is mounted, the click member 36 is pushed down and the coil spring 35 is deformed into its compressed state. Accordingly, the click member 36 is held against the engaging portion 33 of the bezel 31 by the spring force of the coil spring 35 and the stopper member 49 is held between the shank 36*a* of the click member 36 and the closing surface 42*c* of the operating member 42. The shank 36*a* preferably has its lower end contact the stopper member 49, though a slight clearance may be allowable therebetween. The assembly completed as described is shown in FIG. 3.

The rotation of the bezel 31 in the watch 10 worn on a human arm can be made by a process as will now be described.

Firstly, the push button 42*b* of the operating member 42 is pressed toward the inside of the case band with a single finger by overcoming the spring force of the coil spring 44 without the aid of any tool. As a result, the closing surface 42*c* is displaced from the small diameter hole portion 25*b* of the stepped hole 25 toward the inside of the case band and the depression 45 is connected with the lower end of the small diameter hole portion 25*b*. Consequently, the stopper member 49 drops into the depression 45 by its own weight and a gap G allowing the lowering of the click member 36 is formed between the stopper member 49 and the lower end of the click member 36 as shown in FIG. 4. The vertical dimension of the gap G is equal to the amount L of dropping movement of the stopper member 49.

While the operating member 42 is kept in its pressed state, the bezel 31 is rotated by a desired angle with another finger. As a result, the click member 36 supported by the case band 16 is so engaged with the engaging portion 33 on the rear surface of the bezel 31 that with a change in relative position between the engaging portion 33 and the click member 36, the click member 36 may be pressed down against the coil spring 35 by each downwardly directed convexity of the engaging portion 33 and thereafter caused by the force of the coil spring 35 to enter the concavity of the engaging portion 33 adjoining that convexity. Consequently, each rotation of the bezel 31 by a certain angle produces a click feeling. When the rotation of the bezel 31 is stopped, the click member 36 is held in its engaged state in which it engages in one of the concavities of the engaging portion 33, and the bezel 31 is, thus, held in its desired rotational position.

During its clicking operation as described, the click member 36 can be stable in its vertical movement, since its head 36*b* is guided along the large diameter hole portion 25*a* of the stepped hole 25. Moreover, the engagement of the semi-spherical head 36*b* of the click member 36 in the concavities of the engaging portion 33 of the bezel 31 makes smooth the clicking motion of the click member 36 engaging the bezel 31 for producing a click feeling without any fear of the click member 36 being caught by the serrations of the engaging portion 33 and causing trouble in the rotation of the bezel 31.

Since the downward movement of the click member 36 resisting the coil spring 35 with the rotation of the bezel 31 is allowed by the formation of the gap G as described above, the downwardly directed convexities of the engaging portion 33 are permitted to move past the upper end of the click member 36. Accordingly, the click member 36 does not hinder the clockwise or counterclockwise rotation of the bezel 31, but the bezel 31 is rotatable in either direction. Thus, in the event that the bezel 31 rotated in one direction has erroneously been moved to a somewhat farther position beyond its desired rotational position, it is possible to correct the error easily by rotating the bezel 31 in the opposite direction from its somewhat farther position by the amount of its erroneous movement, so that the bezel 31 may stay in its desired rotational position.

When the operating member 42 is released from pressure after the rotation of the bezel 31 by a desired angle, the operating member 42 is pushed back by the spring force of the coil spring 44 and held in its locking position shown in FIG. 3A by the retaining ring 43. As a result, the stopper member 49 is pushed up from the depression 45 by its push-up surface 45*a* and immediately thereafter, the closing surface 42*c* is so situated as to close the lower end opening of the small diameter hole portion 25*b*.

Accordingly, the stopper member 49 is supported on the closing surface 42*c* and situated in contact with the lower end of the click member 36 or in close proximity thereto to prevent the lowering of the click member 36. Thus, the downward movement of the click member 36 is hindered by the stopper member 49 of the locking mechanism 41. Therefore, the bezel 31 set in its desired rotational position can thereafter be held against any inadvertent rotation even if any external force tending to rotate the bezel 31 may act on it when the watch 10 is carried.

As the coil spring 35, the click member 36 and the locking mechanism 41 are mounted not in the bezel 31, but in the case band 16, the original or natural size of the case band 16 can be utilized to mount the locking mechanism 41, etc. undertaking a click motion when the bezel 31 is rotated, and holding it in its position where its rotation has been stopped, and it is not necessary to increase the thickness, etc. of the case band 16. The mounting of the locking mechanism 41, etc. in the bezel 31 is undesirable, since a mounting space required of the bezel 31 makes it necessary to increase its diameter and thickness.

Moreover, as the locking mechanism 41, etc. are mounted in the case band 16, the finger pressing the operating member 42 is not moved with the rotation of the bezel 31. Accordingly, the rotation of the bezel 31 hardly causes any change in the angle of the wrist, etc. even when a large amount of rotation has to be given to the bezel 31 with the watch worn on the wrist. Therefore, there is no tight or uncomfortable movement of particularly the joint of the wrist, but the bezel 31 can be rotated easily. When the operating member 42 is pressed with the middle finger of the right hand, the bezel 31 can be rotated with the thumb and index finger of the right hand, or at least the thumb, and when the operating member 42 is pressed with the thumb or index finger of the right hand, the bezel 31 can be rotated with the index finger or thumb of the right hand.

A second embodiment of the present invention will now be described with reference to FIGS. 5 and 6. This embodiment is differentiated from the first one by a click member 36 formed from two members and is otherwise equal to the first embodiment. Accordingly, the structural features which it shares with the first embodiment will be given the symbols used to describe the first embodiment and no description thereof will be repeated.

Figure 5:
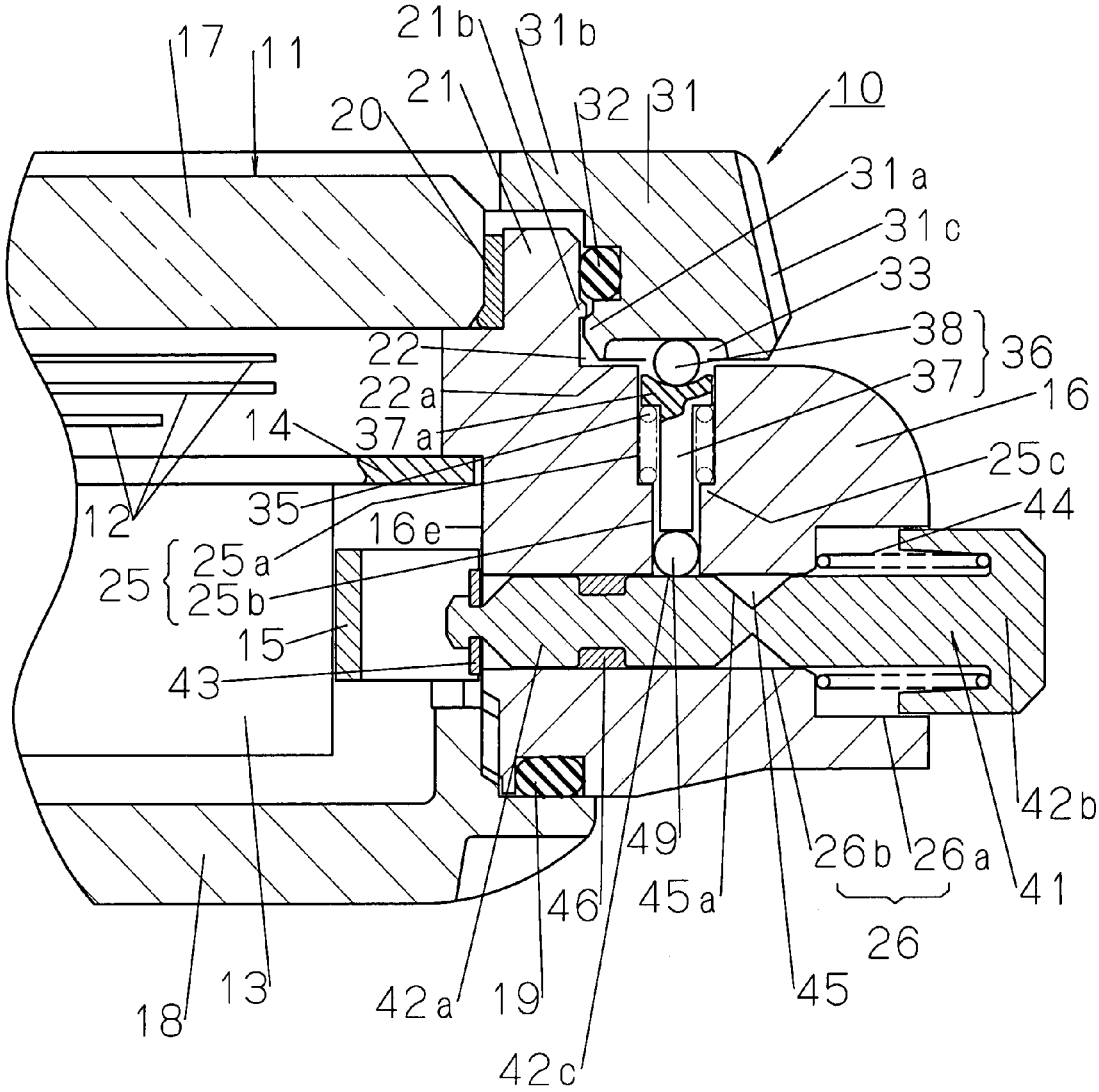
FIG. 5 is a sectional view showing the position in which the bezel which the watch according to a second embodiment of the present invention includes has been locked against rotation.
Figure 6:
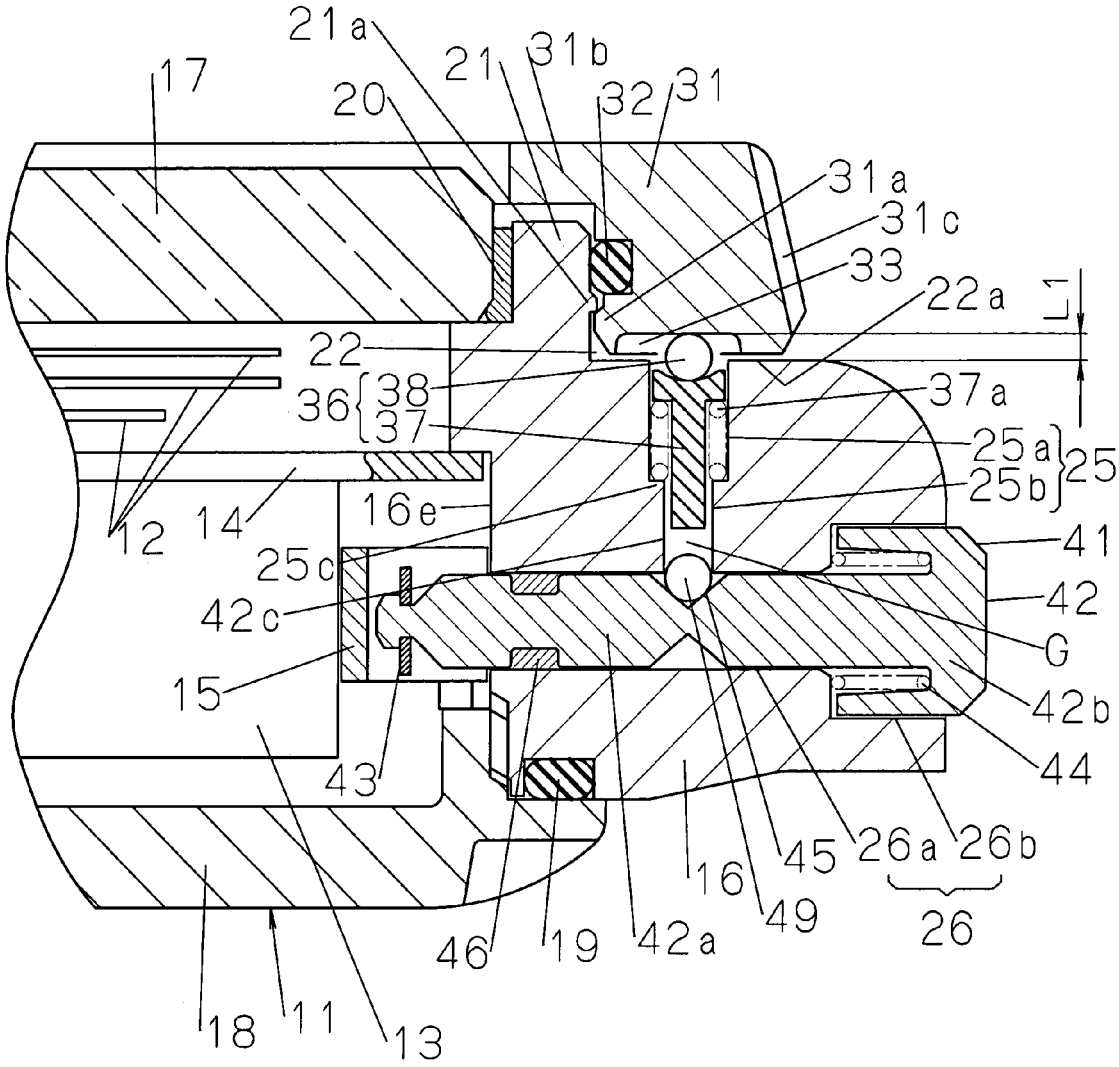
FIG. 6 is A sectional view showing the position in which the bezel which the watch according to the second embodiment of the present invention includes has been unlocked for rotation.

The click member 36 is composed of a shank 37 and a head 38 as shown in FIGS. 5 and 6. The shank 37 has a head rest 37*a* at its upper end. The head rest 37*a* is circular in top plan and is fitted slidably in the large diameter hole portion 25*a* of a stepped hole 25. The head rest 37*a* has a concave top surface. The head 38 is formed by a sphere, for example, a steel ball. The head 38 stays rotatably on the head rest 37*a*. The head 38 is held between the head rest 37*a* and a bezel 31 by the spring force of a coil spring 35 and is engaged with the engaging portion 33 of the bezel 31. In any other respect, the second embodiment is equal to the first embodiment.

Therefore, the bezel 31 of the watch 10 according to the second embodiment is easy to position and can be held against any inadvertent rotation after it has been set in position, for the same reasons as those which have been explained in connection with the first embodiment.

According to the second embodiment, moreover, the head 38 rotates on the head rest 37*a* each time the bezel 31 is rotated, since the click member 36 is formed by the shank 37 and the head 38 composed of a sphere placed rotatably on the head rest 37*a* of the shank 37. As a result, a smooth click motion can be obtained. Moreover, the rotation of the head 38 causes its area of contact with the engaging portion 33 of the bezel 31 to change, which is desirable for preventing the wear of the head 38 in one specific area of contact from occurring to a greater extent than in any other area of the head 38.

Although according to each embodiment described above, there is a slight clearance between the rear surface of the bezel 31 and the bottom surface 22*a* of the bezel mounting portion 22 facing it, it will alternatively be possible to make the rear surface of the bezel and the bottom surface 22*a* in slight contact with each other so that no such clearance may exist. It will also be possible to form the bezel 31 by a bezel main body having a bezel gasket 32 fitted thereon and an engaging portion 33 formed on its rear surface and a cover 31*b* molded separately from the main body and joined thereto by swaging or otherwise.

What is claimed is:

1. A timepiece comprising:

a case band having a bezel mounting portion formed by an annular recess which is open at its top and along its outer periphery, a stepped hole formed by a large diameter hole portion open in the bottom surface of the mounting portion and a small diameter hole portion connected with the lower end of that hole portion, and a accommodating portion connected with the lower end of the small diameter hole portion and crossing the stepped hole at right angles thereto;

an annular bezel mounted in the bezel mounting portion rotatably both clockwise and counterclockwise relative to the case band and having an engaging portion formed in its rear surface facing the bottom surface of the bezel mounting portion by a plurality of serrations lying in the direction of its rotation;

a click member held in the stepped hole vertically movably for engaging the engaging portion or disengaging therefrom;

an urging body held in the large diameter hole portion for urging the click member toward the engaging portion normally;

an operating member having a depression having an oblique push-up surface and a closing surface contiguous from the push-up surface at the open end of the depression and held in the accommodating portion movably to have its depression positioned in its unlocking position contiguous to the lower end of the small diameter hole portion by operation from outside the case band;

an urging member urging the operating member normally for positioning the operating member in its locking position in which its closing surface closes the lower end of the small diameter hole portion; and a stopper member positioned between the click and operating members movably into and out of the depression along the push-up surface by movement of the operating member so that when it has left the depression and is supported on the closing surface, it may restrict the movement of the click member away from the engaging portion, while it relieves the click member from its restriction and allows its vertical movement when it has dropped into the depression.

2. A timepiece as set forth in claim 1, wherein the click member is formed by a shank having a lower end engageable with the stopper member from above and a semi-spherical head formed at the upper end of the shank as an integral part thereof engageably with the engaging portion, while supporting the urging body.

3. A timepiece as set forth in claim 1, wherein the click member is formed by a shank having a lower end engageable with the stopper member from above and a head rest at its upper end, and a head formed by a ball positioned on the head rest rotatably and engageably with the engaging portion.

4. A timepiece as set forth in claim 1, wherein the accommodating portion is formed by a hole extending radially of the case band, the operating member is formed by an inserted shaft fitted slidably in the accommodating portion and a push button formed as an integral part of the shaft and protruding outward from the case band and the depression is defined by a single continuous groove formed along the circumference of the inserted shaft, while the closing surface is defined by the circumferential surface of the inserted shaft which is situated more inwardly of the case band than the depression is.

5. A timepiece as set forth in claim 2, wherein the accommodating portion is formed by a hole extending radially of the case band, the operating member is formed by an inserted shaft fitted slidably in the accommodating portion and a push button formed as an integral part of the shaft and protruding outward from the case band and the depression is defined by a single continuous groove formed along the circumference of the inserted shaft, while the closing surface is defined by the circumferential surface of the inserted shaft which is situated more inwardly of the case band than the depression is.

6. A timepiece as set forth in claim 3, wherein the accommodating portion is formed by a hole extending radially of the case band, the operating member is formed by an inserted shaft fitted slidably in the accommodating portion and a push button formed as an integral part of the shaft and protruding outward from the case band and the depression is defined by a single continuous groove formed along the circumference of the inserted shaft, while the closing surface is defined by the circumferential surface of the inserted shaft which is situated more inwardly of the case band than the depression is.

7. A timepiece as set forth in claim 1, wherein the stopper member is formed by a sphere.

8. A timepiece as set forth in claim 2, wherein the stopper member is formed by a sphere.

9. A timepiece as set forth in claim 3, wherein the stopper member is formed by a sphere.

10. A timepiece as set forth in claim 4, wherein the stopper member is formed by a sphere.

11. A timepiece as set forth in claim 5, wherein the stopper member is formed by a sphere.

12. A timepiece as set forth in claim 6, wherein the stopper member is formed by a sphere.

* * * * *